US008915799B2

(12) United States Patent
Hebert et al.

(10) Patent No.: US 8,915,799 B2
(45) Date of Patent: Dec. 23, 2014

(54) VARIABLE MOMENT OF INERTIA GOLF BALL

(75) Inventors: Edmund A. Hebert, Mattapoisett, MA (US); Derek A. Ladd, Acushnet, MA (US); Nicholas M. Nardacci, Bristol, RI (US); Jeffrey L. Dalton, Larchmont, NY (US)

(73) Assignee: Acushnet Company, Fairhaven, MA (US)

( * ) Notice: Subject to any disclaimer, the term of this patent is extended or adjusted under 35 U.S.C. 154(b) by 379 days.

(21) Appl. No.: 13/267,498

(22) Filed: Oct. 6, 2011

(65) Prior Publication Data

US 2013/0090187 A1 Apr. 11, 2013

(51) Int. Cl.

| | |
|---|---|
| ***A63B 37/04*** | (2006.01) |
| ***A63B 37/08*** | (2006.01) |
| ***A63B 37/00*** | (2006.01) |

(52) U.S. Cl.

CPC ..... *A63B 37/0075* (2013.01); *A63B 37/0043* (2013.01); *A63B 37/0076* (2013.01); *A63B 37/0003* (2013.01); *A63B 37/0064* (2013.01); *A63B 37/0045* (2013.01); *A63B 37/0059* (2013.01); *A63B 37/0077* (2013.01); *A63B 37/0023* (2013.01); *A63B 37/0039* (2013.01)

USPC ..... 473/354; 473/368; 473/371; 473/377

(58) Field of Classification Search

CPC ..... A63B 37/0052
USPC ..... 473/351–377
See application file for complete search history.

(56) References Cited

U.S. PATENT DOCUMENTS

| | | | | |
|---|---|---|---|---|
| 1,192,831 | A * | 7/1916 | Knight | 473/354 |
| 1,426,712 | A * | 8/1922 | Chatfield | 473/354 |
| 1,524,171 | A * | 1/1925 | Chatfield | 473/373 |
| 5,597,365 | A | 1/1997 | Yamada et al. | |
| 5,683,312 | A | 11/1997 | Boehm et al. | |
| 5,919,100 | A | 7/1999 | Boehm et al. | |
| 5,984,805 | A * | 11/1999 | Maruko | 473/354 |
| 6,174,245 | B1 | 1/2001 | Stanton et al. | |
| 6,232,389 | B1 * | 5/2001 | Feeney et al. | 524/450 |
| 6,514,157 | B2 | 2/2003 | Jordan et al. | |
| 6,692,379 | B2 * | 2/2004 | Morgan et al. | 473/371 |
| 6,932,720 | B2 * | 8/2005 | Hogge et al. | 473/374 |
| 7,182,702 | B2 * | 2/2007 | Hogge et al. | 473/374 |
| 7,232,382 | B2 * | 6/2007 | Kennedy et al. | 473/354 |
| 8,535,169 | B2 * | 9/2013 | Molinari | 473/200 |

* cited by examiner

*Primary Examiner* — Alvin Hunter
(74) *Attorney, Agent, or Firm* — Kristin D. Wheeler

(57) ABSTRACT

A golf ball having a core that includes an aqueous solution contained by a boundary layer with a solid center suspended in the solution to modify the moment of inertia of the golf ball. The aqueous solution can be thixotropic, or rheopectic, or dilatant, or pseudoplastic in nature and the center formulated to simulate the specific gravity of the solution.

22 Claims, 1 Drawing Sheet

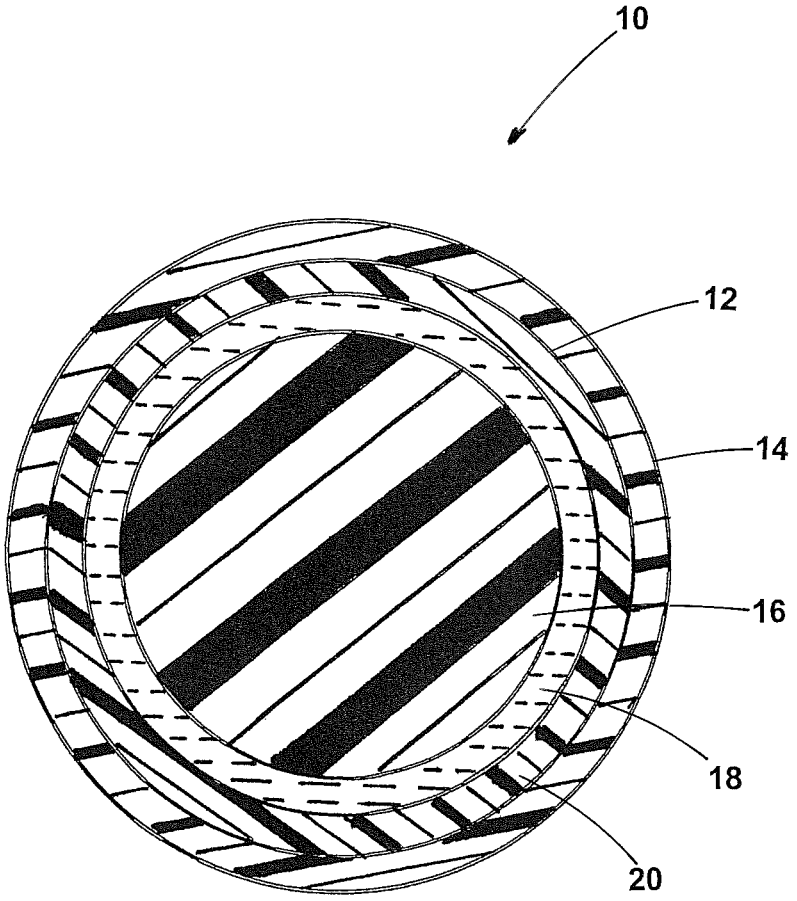
10
12
14
16
18
20

VARIABLE MOMENT OF INERTIA GOLF BALL

FIELD OF THE INVENTION

The present invention is directed to a golf ball and, more particularly, a golf ball core having a center suspended in a thin layer of an aqueous solution contained within a boundary layer.

BACKGROUND OF THE INVENTION

Generally, golf balls have been classified as solid balls or wound balls. Solid balls are generally classified as two, three, or four piece balls. Two piece balls are comprised of a solid polymeric core and cover. These balls are generally easy to manufacture, but are regarded as having limited playing characteristics. Three and four piece balls are comprised of a solid or liquid filled center surrounded by tensioned elastomeric material and a cover. Three and four piece balls generally have a good "click" and "feel" when struck by a golf club, but are more difficult to manufacture than two piece balls.

The prior art is comprised of various golf balls that have been designed to provide optimal playing characteristics. These characteristics are generally the initial velocity and spin of the golf ball, which can be optimized for various players. For instance, certain players prefer to play a ball that has a high spin rate for playability. Other players prefer to play a ball that has a low spin rate to maximize distance. The ideal ball has low spin when struck with the driver and high spin when landing on the green.

The prior art is also comprised of various liquid filled golf balls. Wound golf balls have been made with liquid centers for many years. U.S. Pat. Nos. 1,568,513 and 1,904,012 are directed to wound golf balls with liquid filled centers. U.S. Pat. Nos. 5,150,906 and 5,480,155, are directed to a hollow spherical shell of a polymeric material which is filled with a liquid or unitary, non-cellular material that is a liquid when introduced into the shell. The shell is disclosed as being the outer cover or an inner layer with the outer cover formed to the external surface thereof. The shell varies in thickness from about 0.060 to 0.410 inches in thickness.

The Rules of Golf as approved by the United States Golf Association (USGA), include the following rules that relate to golf ball construction:

a. Weight: The weight of the ball shall not be greater than 1.620 ounces avoirdupois (45.92 gm).

b. Size: The diameter of the ball shall be not less than 1.680 inches (42.67 mm). This specification will be satisfied if, under its own weight, a ball falls through a 1.680 inches diameter ring gauge in fewer than 25 out of 100 randomly selected positions, the test being carried out at a temperature of 23+/−1° C.

c. Spherical Symmetry: The ball must not be designed, manufactured or intentionally modified to have properties which differ from those of a spherically symmetrical ball.

d. Initial Velocity: The velocity of the ball shall not be greater than 250 feet (76.2 m) per second when measured on apparatus approved by the United States Golf Association. A maximum tolerance of 2% will be allowed. The temperature of the ball when tested will be 23+/−1° C.

e. Overall Distance Standard (ODS): A brand of golf ball, when tested on apparatus approved by the USGA on the outdoor range at the USGA Headquarters under the conditions set forth in the Overall Distance Standard for golf balls on file with the USGA, shall not cover an average distance in carry and roll exceeding 280 yards (256 m) plus a tolerance of 6%.

The flight of a golf ball is determined by many factors, but only three factors that are typically controlled by the golfer. By impacting the ball with a golf club, the golfer typically controls the speed of the golf ball, the launch angle and the spin rate. The launch angle sets the initial trajectory of the golf ball's flight. The speed and spin of the ball give the ball lift which will define the ball's overall flight path along with the weight and drag of the golf ball. Where the ball stops after being struck by a golf club depends greatly on the weather and the landing surface the ball contacts.

Many golfers have what is termed a "low swing speed." This means that the club head speed at impact is relatively slow when compared to a professional golfer. Typically, when driving a golf ball the average professional golf ball speed is approximately 234 ft/s (160 mph). A person having a low swing speed typically drives the ball at a speed less than 176 ft/s (120 mph). Upwards of thirty percent of all golfers today have swing speeds that produce drives of less than 210 yards. A person with a low swing speed has a low ball speed. His or her ball does not fly very far because of the lack of speed and lift. No matter what a golfer's swing speed, every innovative idea seeks to reduce a golf ball's downrange spin, while enhancing spin once the ball lands on the green. The present invention seeks to achieve this by modifying the golf ball's moment of inertia/radius of gyration.

SUMMARY OF THE INVENTION

The present invention comprises a golf ball having a core and a cover in which the core is comprised of a boundary layer containing a solid center suspended in an aqueous solution, therein aiding in modifying the moment of inertia of the ball when struck by a golf club.

Still further, the aqueous solution is non-Newtonian and may be selected from materials that are thixotropic, rheopectic, dilatant or pseudoplastic in nature to aid in enhancing the effect.

Still further, the solid center must be of a specific gravity that is within 0.08%, preferably within 0.05%, to the specific gravity of the aqueous solution to minimize any settlement of the center within the liquid suspension.

The solid center may have surface texture or molded artifacts designed to alter its drag within the aqueous solution. Further, this surface texture can be used to increase or decrease the fluid viscosity by altering shear rate of the fluid.

The center of the golf ball golf ball is formulated of a polybutadiene, ionomer/highly neutralized polymer or thermoplastic urethane and the cover material selected from the group consisting of thermoplastic urethane, or thermoset polyurethane, or ionomer resins, or low modulus ionomers, or high modulus ionomers and blends thereof.

The aqueous solution is selected from a non-Newtonian group of materials such as corn starch and water, or silica and poly(ethylene glycol), or clay, or gypsum paste, or nanocellulose, or benzene, or carbon tetrachloride, or ethanol, or pentane.

BRIEF DESCRIPTION OF DRAWING

The drawing is a sectional view of a ball of the present invention with a core and a cover, the core having a decoupled center suspended in a thin layer of an aqueous solution contained within a boundary layer.

DESCRIPTION OF THE PREFERRED EMBODIMENT

Referring to the drawing, a ball 10 includes a core 12 and a cover 14. The golf ball's moment of inertia/radius of gyration is modified by the core 12 having a mechanically decoupled center 16 suspended in a thin layer of an aqueous solution 18 contained within a boundary layer 20. The center 16 may be formulated to match the specific gravity of the aqueous boundary layer 18, therein minimizing any settlement of the center 16 within its liquid suspension. It is anticipated that the aqueous solution is non-Newtonian and can be selected from: thixotropic, wherein the apparent viscosity decreases with the duration that it is put under stress; or rheopectic, wherein the apparent viscosity increases with the duration of stress. Both of these are time-dependent viscosities. Examples of rheopectic materials can be some lubricants or whipped cream. Examples of thixotropic materials would be clays, some drilling muds, and many paints. The non-Newtonian materials could also be selected from those materials in which the viscosities are independent of time such as dilatant materials (shear thickening), wherein the apparent viscosity decreases with the duration of the stress, or pseudoplastic (shear thinning) wherein the viscosity decreases with increased stress. Examples of dilatant materials are suspensions of corn starch, or sand in water, clay, gypsum paste, nano-cellulose, while examples of pseudoplastic materials are paper pulp in a water solution, latex paint, ice, blood, or surfactant/soap mixtures. While it is the intent for the invention to partner the center 16 with a non-wound construction, it is to be appreciated that this center construction may be applied to any golf ball in the prior art.

By being suspended within the aqueous solution and being a solid mass the center 16 helps to create a stronger effect on the shift of moment of inertia (MOI), as a greater effort is required to bring the entire mass of the solid mass from rest to rotational motion.

Suitable rubber compositions for forming the center 16 comprise a base rubber, an initiator agent, a coagent, and optionally one or more of a zinc oxide, zinc stearate or stearic acid, antioxidant, and a soft and fast agent. Suitable base rubbers include natural and synthetic rubbers including, but not limited to, polybutadiene, polyisoprene, ethylene propylene rubber ("EPR"), styrene-butadiene rubber, styrenic block copolymer rubbers (such as SI, SIS, SB, SBS, SIBS, and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof. Diene rubbers are preferred, particularly polybutadiene, styrene-butadiene, and mixtures of polybutadiene with other elastomers wherein the amount of polybutadiene present is at least 40 wt % based on the total polymeric weight of the mixture. Particularly preferred polybutadienes include high-cis neodymium-catalyzed polybutadienes and cobalt-, nickel-, or lithium-catalyzed polybutadienes. Suitable examples of commercially available polybutadienes include, but are not limited to, Buna CB high-cis neodymium-catalyzed polybutadiene rubbers, such as Buna CB 23, and Taktene® high-cis cobalt-catalyzed polybutadiene rubbers, such as Taktene® 220 and 221, commercially available from LANXESS® Corporation; SE BR-1220, commercially available from The Dow Chemical Company; Europrene® NEOCIS® BR 40 and BR 60, commercially available from Polimeri Europa®; UBEPOL-BR® rubbers, commercially available from UBE Industries, Inc.; BR 01, commercially available from Japan Synthetic Rubber Co., Ltd.; and Neodene high-cis neodymium-catalyzed polybutadiene rubbers, such as Neodene BR 40, commercially available from Karbochem.

Suitable initiator agents include organic peroxides, high energy radiation sources capable of generating free radicals, and combinations thereof. High energy radiation sources capable of generating free radicals include, but are not limited to, electron beams, ultra-violet radiation, gamma radiation, X-ray radiation, infrared radiation, heat, and combinations thereof. Suitable organic peroxides include, but are not limited to, dicumyl peroxide; n-butyl-4,4-di(t-butylperoxy)valerate; 1,1-di(t-butylperoxy)3,3,5-trimethylcyclohexane; 2,5-dimethyl-2,5-di(t-butylperoxy)hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; lauryl peroxide; benzoyl peroxide; and combinations thereof. Examples of suitable commercially available peroxides include, but are not limited to Perkadox® BC dicumyl peroxide, commercially available from Akzo Nobel, and Varox® peroxides, such as Varox® ANS benzoyl peroxide and Varox® 231 1,1-di(t-butylperoxy)3,3,5-trimethylcyclohexane, commercially available from RT Vanderbilt Company, Inc. Peroxide initiator agents are generally present in the rubber composition in an amount of at least 0.05 parts by weight per 100 parts of the base rubber, or an amount within the range having a lower limit of 0.05 parts or 0.1 parts or 0.8 parts or 1 part or 1.25 parts or 1.5 parts by weight per 100 parts of the base rubber, and an upper limit of 2.5 parts or 3 parts or 5 parts or 6 parts or 10 parts or 15 parts by weight per 100 parts of the base rubber.

Coagents are commonly used with peroxides to increase the state of cure. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, nickel, and sodium. In a particular embodiment, the coagent is selected from zinc salts of acrylates, diacrylates, methacrylates, dimethacrylates, and mixtures thereof. In another particular embodiment, the coagent is zinc diacrylate. When the coagent is zinc diacrylate and/or zinc dimethacrylate, the coagent is typically included in the rubber composition in an amount within the range having a lower limit of 1 or 5 or 10 or 15 or 19 or 20 parts by weight per 100 parts of the base rubber, and an upper limit of 24 or 25 or 30 or 35 or 40 or 45 or 50 or 60 parts by weight per 100 parts of the base rubber. When one or more less active coagents are used, such as zinc monomethacrylate and various liquid acrylates and methacrylates, the amount of less active coagent used may be the same as or higher than for zinc diacrylate and zinc dimethacrylate coagents. The desired compression may be obtained by adjusting the amount of crosslinking, which can be achieved, for example, by altering the type and amount of coagent.

The rubber composition optionally includes a curing agent. Suitable curing agents include, but are not limited to, sulfur; N-oxydiethylene 2-benzothiazole sulfenamide; N,N-di-ortho-tolylguanidine; bismuth dimethyldithiocarbamate;

N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof.

The rubber composition optionally contains one or more antioxidants. Antioxidants are compounds that can inhibit or prevent the oxidative degradation of the rubber. Some antioxidants also act as free radical scavengers; thus, when antioxidants are included in the rubber composition, the amount of initiator agent used may be as high or higher than the amounts disclosed herein. Suitable antioxidants include, for example, dihydroquinoline antioxidants, amine type antioxidants, and phenolic type antioxidants.

The rubber composition may contain one or more fillers to adjust the density and/or specific gravity of the core to approximate the density and/or specific gravity of the aqueous solution 18. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, polyvinyl chloride, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, regrind (i.e., core material that is ground and recycled), nanofillers and combinations thereof. The amount of particulate material(s) present in the rubber composition is typically within a range having a lower limit of 5 parts or 10 parts by weight per 100 parts of the base rubber, and an upper limit of 30 parts or 50 parts or 100 parts by weight per 100 parts of the base rubber. Filler materials may be dual-functional fillers, such as zinc oxide (which may be used as a filler/acid scavenger) and titanium dioxide (which may be used as a filler/brightener material).

The rubber composition may also contain one or more additives selected from processing aids, processing oils, plasticizers, coloring agents, fluorescent agents, chemical blowing and foaming agents, defoaming agents, stabilizers, softening agents, impact modifiers, free radical scavengers, accelerators, scorch retarders, and the like. The amount of additive(s) typically present in the rubber composition is typically within a range having a lower limit of 0 parts by weight per 100 parts of the base rubber, and an upper limit of 20 parts or 50 parts or 100 parts or 150 parts by weight per 100 parts of the base rubber.

The rubber composition optionally includes a soft and fast agent. Preferably, the rubber composition contains from 0.05 phr to 10.0 phr of a soft and fast agent. In one embodiment, the soft and fast agent is present in an amount within a range having a lower limit of 0.05 or 0.1 or 0.2 or 0.5 phr and an upper limit of 1.0 or 2.0 or 3.0 or 5.0 phr. In another embodiment, the soft and fast agent is present in an amount of from 2.0 phr to 5.0 phr, or from 2.35 phr to 4.0 phr, or from 2.35 phr to 3.0 phr. In an alternative high concentration embodiment, the soft and fast agent is present in an amount of from 5.0 phr to 10.0 phr, or from 6.0 phr to 9.0 phr, or from 7.0 phr to 8.0 phr. In another embodiment, the soft and fast agent is present in an amount of 2.6 phr.

Suitable soft and fast agents include, but are not limited to, organosulfur and metal-containing organosulfur compounds; organic sulfur compounds, including mono, di, and polysulfides, thiol, and mercapto compounds; inorganic sulfide compounds; blends of an organosulfur compound and an inorganic sulfide compound; Group VIA compounds; substituted and unsubstituted aromatic organic compounds that do not contain sulfur or metal; aromatic organometallic compounds; hydroquinones; benzoquinones; quinhydrones; catechols; resorcinols; and combinations thereof.

As used herein, "organosulfur compound" refers to any compound containing carbon, hydrogen, and sulfur, where the sulfur is directly bonded to at least 1 carbon. As used herein, the term "sulfur compound" means a compound that is elemental sulfur, polymeric sulfur, or a combination thereof. It should be further understood that the term "elemental sulfur" refers to the ring structure of $S_8$ and that "polymeric sulfur" is a structure including at least one additional sulfur relative to elemental sulfur.

Suitable types and amounts of base rubber, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication No. 2007/0093318, the entire disclosure of which is hereby incorporated herein by reference.

The cover 14 provides the interface between the ball 10 and a club. Properties that are desirable for the cover are good flowability, high abrasion resistance, high tear strength, high resilience, and good mold release, among others.

The cover may have one or more layers. Suitable cover materials include, but are not limited to, ionomer resins and blends thereof (e.g., Surlyn® ionomer resins and DuPont® HPF 1000 and HPF 2000, commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene-ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof. Suitable cover materials and constructions also include, but are not limited to, those disclosed in U.S. Pat. Nos. 6,117,025, 6,767,940, and 6,960,630, the entire disclosures of which are hereby incorporated herein by reference.

Ionomer-based compositions are known to be useful as a golf ball cover material, and particularly as a golf ball inner cover layer material. Thus, in one embodiment, the present invention provides golf balls which do not include a layer formed from an ionomer-based composition. In embodiments of the present invention wherein the golf ball does include a layer formed from an ionomer-based composition, preferred ionomeric compositions include:

(a) a composition comprising a "high acid ionomer" (i.e., having an acid content of greater than 16 wt %), such as Surlyn 8150®;

(b) a composition comprising a high acid ionomer and a maleic anhydride-grafted non-ionomeric polymer (e.g., Fusabond® maleic anhydride-grafted metallocene-catalyzed ethylene-butene copolymers). A particularly preferred blend of high acid ionomer and maleic anhydride-grafted polymer is a 84 wt %/16 wt % blend of Surlyn 8150® and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;

(c) a composition comprising a 50/45/5 blend of Surlyn® 8940/Surlyn® 9650/Nucrel® 960, preferably having a material hardness of from 80 to 85 Shore C;

(d) a composition comprising a 50/25/25 blend of Surlyn® 8940/Surlyn® 9650/Surlyn® 9910, preferably having a material hardness of about 90 Shore C;

(e) a composition comprising a 50/50 blend of Surlyn® 8940/Surlyn® 9650, preferably having a material hardness of about 86 Shore C;

(f) a composition comprising a blend of Surlyn® 7940/Surlyn® 8940, optionally including a melt flow modifier;

(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9150), optionally including one or more melt flow modifiers such as an ionomer, ethylene-acid copolymer or ester terpolymer; and (h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140, 40-50 wt % Surlyn® 9120, and 0-10 wt % Surlyn® 6320).

Surlyn 8150®, Surlyn® 8940, and Surlyn® 8140 are different grades of E/MAA copolymer in which the acid groups have been partially neutralized with sodium ions. Surlyn® 9650, Surlyn® 9910, Surlyn® 9150, and Surlyn® 9120 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Surlyn® ionomers, Fusabond® copolymers, and Nucrel® copolymers are commercially available from E. I. du Pont de Nemours and Company.

Ionomeric cover compositions can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, plyethylene-(meth)acrylic acid, functionalized polymers with maleic anhydride grafting, Fusabond® functionalized olefins commercially available from E. I. du Pont de Nemours and Company, functionalized polymers with epoxidation, elastomers (e.g., ethylene propylene diene monomer rubber, metallocene-catalyzed polyolefin) and ground powders of thermoset elastomers.

Suitable ionomeric cover materials are further disclosed, for example, in U.S. Pat. Nos. 6,653,382, 6,756,436, 6,894,098, 6,919,393, and 6,953,820, the entire disclosures of which are hereby incorporated by reference.

Polyurethanes, polyureas, and blends and hybrids of polyurethane/polyurea are particularly suitable for forming cover layers of golf balls of the present invention. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Polyurethane cover compositions of the present invention include those formed from the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, i.e., as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-((3-hydroxyethyl)ether; hydroquinone-di-(β-hydroxyethyl) ether; trimethylol propane; and combinations thereof.

Suitable polyurethane cover compositions of the present invention also include those formed from the reaction product of at least one isocyanate and at least one curing agent or the reaction produce of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p,p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); and combinations thereof.

The present invention is not limited by the use of a particular polyisocyanate in the cover composition. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate, cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than 14% unreacted NCO groups. Preferably, the at least one polyisocyanate has no greater than 8.5% NCO, more preferably from 2.5% to 8.0%, even more preferably from 4.0% to 7.2%, and most preferably from 5.0% to 6.5%.

The present invention is not limited by the use of a particular polyol in the cover composition. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent of the present invention includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(4-hydroxyethyl)ether; hydroquinone-di-(4-hydroxyethyl)ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

Suitable polyurethanes are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyureas are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

Golf ball cover compositions may include a flow modifier, such as, but not limited to, Nucrel® acid copolymer resins, and particularly Nucrel® 960. Nucrel® acid copolymer resins are commercially available from E. I. du Pont de Nemours and Company.

Cover compositions may also include one or more filler(s), such as the fillers given above for rubber compositions of the present invention (e.g., titanium dioxide, barium sulfate, etc.), and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Additional suitable cover materials are disclosed, for example, in U.S. Patent Application Publication No. 2005/0164810, U.S. Pat. No. 5,919,100, and PCT Publications WO00/23519 and WO00/29129, the entire disclosures of which are hereby incorporated herein by reference.

In accordance with the various embodiments of the present invention, the cover 14 is of a thickness to generally provide sufficient strength, good performance characteristics and durability. Preferably, the cover 14 is of a thickness from about 0.02 inches to about 0.12 inches. More preferably, the cover 14 is about 0.03 to 0.09 inches in thickness and, most preferably, is about 0.03 to 0.085 inches in thickness.

The cover 14 can also be comprised of one or more layers. For example, a is preferred embodiment is disclosed in U.S. Pat. No. 5,885,172, which is incorporated by reference herein in its entirety.

The cover 14 preferably comprise one or more layers that are injection molded, compression molded, cast or reaction injection molded.

The boundary layer 20 contains the aqueous solution 18 with the center 16 suspended in the solution. Boundary layer 20 is shown as a single layer, but can be one or more layers made from one or more materials. Boundary layer 20 is preferably made of a thermoset rubber such as polyisoprene, styrene butadiene, polybutadiene and combinations thereof; a plastic, such as polypropylene; or a thermoplastic elastomeric material such as copolymers of methyl-methacrylate with butadiene and styrene, copolymers of methyl-acrylate with butadiene and styrene, acrylonitrile styrene copolymers, polyether-ester, polyether-amide, polyurethane and/or blends thereof. Most preferably, boundary layer 20 is comprised of a flexible thermoplastic as set forth in U.S. Pat. No. 6,174,245, which is incorporated by reference herein in its entirety. Boundary layer 20 has an outer diameter of approximately 0.75 to 1.50 inches and preferably 1.00 to 1.30 inches.

The hardness and resiliency of the boundary layer 20 can be varied to achieve certain desired parameters such as spin rate, compression and initial velocity. An intermediate layer is not shown in the drawing but it is appreciated that an intermediate layer (between the boundary and cover) formed form materials such as butyl rubber or a highly neutralized polymer or an ionomer.

The aqueous solution may include high and low viscosity solutions from those including corn syrup, corn starch/water mixture, salt solutions, surfactant soaps or silica, poly(ethylene glycol), clay, gypsum paste, nano-cellulose, benzene, carbon tetrachloride, ethanol or pentane.

The aqueous solution can be varied to modify the performance parameters of the ball, such as the moment of inertia. Preferably, the liquid is comprised of a material that can modify the viscous nature of the liquid, either increasing or decreasing the rate of change of viscosity as a function of strain rate or shear rate. Preferably, the specific gravity of the fluid is below or equal to 0.8 to 1.0. Still further, the fluid is preferably comprised of a material with a low viscosity for a golf ball having a high spin rate and a material having a high viscosity for a golf ball having a low spin rate. Preferably, the viscosity of the fluid or liquid center is less than 100 cps for low viscosity centers and greater than or equal to 100 cps for high viscosity centers. More preferably, the viscosity of the fluid or liquid center is less than or equal to 10 cps for low viscosity centers. The viscosity can be lowered by adding fillers such as pastes to form a suspension with a low viscosity. Preferably, the liquid viscosity is between 100 and 1500 cps for high viscosity centers. Most preferably, the liquid center viscosity is greater than about 500 cps for high viscosity centers.

The center 16 is preferably 60 to 95% of the total ball weight, and more preferably 75 to 86% of the ball weight. The center 16 preferably has an outer diameter of about 0.70 to 1.20 inches. As stated above, the weight distribution within the center 16 can be varied to achieve certain desired parameters such as spin rate, compression and initial velocity. For example, by decreasing the amount of the aqueous solution 18 and therein increasing the diameter of the center 16, the weight distribution of the core is moved toward the outer diameter for a lower spin rate ball. In contrast, the diameter of the center 16 can be decreased and the amount of aqueous solution 18 increased to move the weight distribution of the ball towards the ball center for a high spin rate ball. It is important that the specific gravity of the aqueous solution be within 0.08% of the specific gravity of the center, and preferably within 0.05%. This will minimize any settlement of the center within its liquid suspension. The center 16 may have a surface texture or molded artifacts designed to alter its drag within the aqueous solution.

While it is apparent that the illustrative embodiments of the invention herein disclosed fulfills the objectives stated above, it will be appreciated that numerous modifications and other embodiments may be devised by those skilled in the art. Therefore, it will be understood that the appended claims are intended to cover all such modifications and embodiments which come within the spirit and scope of the present invention.

We claim:

1. A golf ball comprising:

a core and a cover, the core comprising:

a solid center suspended in an aqueous solution; and a boundary layer containing the aqueous solution, wherein a shift occurs in the moment of inertia of the ball when struck by a golf club, and wherein the aqueous solution is non-Newtonian and wherein the aqueous solution is thixotropic in nature; and wherein the center is of a specific gravity that is within 0.08% of the specific gravity of the aqueous solution, thereby minimizing any settlement of the center within the aqueous solution.

2. The golf ball of claim 1, wherein the center is formulated of a polybutadiene, ionomer/highly neutralized polymer or thermoplastic urethane.

3. The golf ball of claim 1, wherein the cover material is selected from the group consisting of thermoplastic urethane, or thermoset polyurethane, or ionomer resins, or low modulus ionomers, or high modulus ionomers and blends thereof.

4. The golf ball of claim 1, wherein the center has an outer diameter of approximately 0.70 to 1.20 inches.

5. The golf ball of claim 1, wherein the boundary layer has an outer diameter of approximately 0.75 to 1.50 inches.

6. The golf ball of claim 5, wherein the boundary layer has an outer diameter of approximately 1.00 to 1.30 inches.

7. The golf ball of claim 1, wherein the ball further includes an intermediate layer encompassing the boundary layer.

8. The golf ball of claim 7, wherein the intermediate layer is formed from butyl rubber, or highly neutralized polymer, or an ionomer.

9. A golf ball comprising:

a core and a cover, the core comprising:

a solid center suspended in an aqueous solution; and a boundary layer containing the aqueous solution, wherein a shift occurs in the moment of inertia of the ball when struck by a golf club, and wherein the aqueous solution is rheopectic in nature; and wherein the center is of a specific gravity that is within 0.08% of the specific gravity of the aqueous solution, thereby minimizing any settlement of the center within the aqueous solution.

10. A golf ball comprising:

a core and a cover, the core comprising:

a solid center suspended in an aqueous solution; and a boundary layer containing the aqueous solution, wherein a shift occurs in the moment of inertia of the ball when struck by a golf club, and wherein the aqueous solution is dilatant in nature; and wherein the center is of a specific gravity that is within 0.08% of the specific gravity of the aqueous solution, thereby minimizing any settlement of the center within the aqueous solution.

11. A golf ball comprising:

a core and a cover, the core comprising:

a solid center suspended in an aqueous solution; and a boundary layer containing the aqueous solution, wherein a shift occurs in the moment of inertia of the ball when struck by a golf club, and wherein the aqueous solution is pseudoplastic in nature.

12. A golf ball comprising:

a core and a cover, the core comprising:

a solid center suspended in an aqueous solution; and a boundary layer containing the aqueous solution, wherein a shift occurs in the moment of inertia of the ball when struck by a golf club, and wherein the aqueous solution is selected from a non-Newtonian group of materials consisting of corn starch and water, or silica and poly (ethylene glycol), or clay, or gypsum paste, or nanocellulose, or benzene, or carbon tetrachloride, or ethanol, or pentane.

13. A golf ball having a core comprising: a hollow, spherical boundary layer; an aqueous liquid contained within the boundary layer; and, a solid spherical center suspended in the aqueous liquid, wherein the aqueous liquid has a first specific gravity, and the center has a second specific gravity which is within 0.05% of the first; and a cover of at least one layer surrounding the boundary layer, wherein the aqueous solution is thixotropic in nature.

14. The golf ball of claim 13, wherein the solid spherical center has an outer diameter of approximately 0.70 to 1.20 inches.

15. The golf ball of claim 13, wherein the boundary layer has an outer diameter of approximately 0.75 to 1.50 inches.

16. The golf ball of claim 15, wherein the boundary layer has an outer diameter of approximately 1.00 to 1.30 inches.

17. The golf ball of claim 13, wherein the ball further includes an intermediate layer encompassing the boundary layer.

18. The golf ball of claim 13, wherein the intermediate layer is formed of butyl rubber, highly neutralized polymer, or an ionomer.

19. The golf ball of claim 13, wherein the cover is comprised of a material selected from the group consisting of thermoplastic urethane, or thermoset polyurethane, or ionomer resins, or low modulus ionomers, or high modulus ionomers and blends thereof.

20. A golf ball having a core comprising: a hollow, spherical boundary layer; an aqueous liquid contained within the boundary layer; and, a solid spherical center suspended in the aqueous liquid, wherein the aqueous liquid has a first specific gravity, and the center has a second specific gravity which is within 0.05% of the first; and a cover of at least one layer surrounding the boundary layer, wherein the aqueous solution is rheopectic in nature.

21. A golf ball having a core comprising: a hollow, spherical boundary layer; an aqueous liquid contained within the boundary layer; and, a solid spherical center suspended in the aqueous liquid, wherein the aqueous liquid has a first specific gravity, and the center has a second specific gravity which is within 0.05% of the first; and a cover of at least one layer surrounding the boundary layer, wherein the aqueous solution is dilatant in nature.

22. A golf ball having a core comprising: a hollow, spherical boundary layer; an aqueous liquid contained within the boundary layer; and, a solid spherical center suspended in the aqueous liquid, wherein the aqueous liquid has a first specific gravity, and the center has a second specific gravity which is within 0.05% of the first; and a cover of at least one layer surrounding the boundary layer, wherein the aqueous solution is pseudoplastic in nature.

* * * * *